United States Patent [19]

Cunningham

[11] 3,943,328

[45] Mar. 9, 1976

[54] ELECTRIC HEATING ELEMENTS

[75] Inventor: Donald M. Cunningham, Pittsburgh, Pa.

[73] Assignee: Emerson Electric Co., St. Louis, Mo.

[22] Filed: Dec. 11, 1974

[21] Appl. No.: 531,664

[52] U.S. Cl. ..... 219/335; 29/611; 219/316; 219/318; 219/336; 219/523

[51] Int. Cl.[2]..... H05B 1/00; F24B 1/00; H05B 3/04

[58] Field of Search ..... 219/316, 318, 335, 336, 219/381, 523, 536, 538, 544, 546, 549; 29/611, 619, 621

[56] References Cited

UNITED STATES PATENTS

| | | | |
|---|---|---|---|
| 1,849,175 | 3/1932 | Clark et al. | 219/336 X |
| 2,816,207 | 12/1957 | Boggs | 219/523 X |
| 3,582,613 | 6/1971 | Pies | 219/381 |
| 3,754,118 | 8/1973 | Booker | 219/523 |

*Primary Examiner*—C. L. Albritton
*Attorney, Agent, or Firm*—Michael Williams

[57] ABSTRACT

An electric heating element, comprising a tubular sheath formed of a thermoplastic material, an electric resistance element, such as a helical coil of resistance wire within the sheath, compacted refractory material within the sheath to hold the resistance element substantially centered within the sheath and out of engagement with the inner wall surface of the sheath, and means for mounting the sheath to a support wherein the active heating portion of the element is disposed in an environment which is controlled to maintain the sheath temperature below its melting point.

The invention is particularly suited to heat liquids wherein the active heating portion is immersed in the liquid. The mounting means may also be formed of thermoplastic material and may have a terminal block integral therewith or, if a separate terminal block is used, this may be formed of a compatible thermoplastic material. The assembly of the thermoplastic parts may be effected by adhesive, heat sealing or sonic welding.

17 Claims, 9 Drawing Figures

9
16
17
15
14
12
10
11
19
20
33
31
32
30
26
25
27
21
18

12
10
14
15

12
10
15
14

35
18
10
15
14
21

18
36
25
10
15
26
14
27
37

ELECTRIC HEATING ELEMENTS

BACKGROUND AND SUMMARY

Electric heating elements have long been made with a tubular metal sheath and although they have been and still are, commercially acceptable, the metal sheath has caused a multitude of problems. First of all, the metal from which the sheath is made is expensive, and this is particularly true when the sheath is formed of copper or copper alloy, or of stainless steel or other corrosion resistant metals. Further, the formation of the metal tube is comparatively expensive, whether it be seamless or formed by shaping flat metal into tube form and welding the longitudinal split.

In addition to the above, the metal tubular sheath required careful cleaning operations to insure that no deleterious matter contaminated the powdered magnesium oxide which electrically insulated the heating resistor from the sheath and conducted heat from the resistor to the sheath. The magnesium oxide also presented considerable problems since it has to be of high purity and free of contaminants. This required that expensive testing procedures be established and constantly followed.

Further, in use in heating liquids, such as water in a hot water tank, galvanic currents were set up between the sheath and any exposed metal surface of the tank, and such currents caused corrosion of the various anodic metallic components in the system, such as exposed tank surfaces or the protective magnesium anode.

Although many experts have held that it could not be done, I have discovered that the sheath of the electric heating element could be formed of a thermoplastic material and successfully manufactured and operated. This has overcome the many disadvantages of the metal sheathed element, above-noted. First of all, plastic tubing at the present time is considerably less expensive than the metal sheaths heretofore used.

No careful cleaning of the inside wall surface of a plastic sheath is required and only a low grade of magnesium oxide, or any other compactable low cost material may be used, since it need only have minimal electrical insulating properties to support turn-to-turn voltages and the property to compact and to conduct heat from the resistor to the sheath. There is little or no scale build-up on the exterior of the plastic sheath as there is on a metal sheath, and the sheath, being plastic and therefore non-conductive, does not build up a galvanic cell in use, as in the case of a metal sheathed unit. Since there is no voltage stress from the resistor to the plastic sheath, because the latter is non-conductive, all the heretofore required high potential tests for current leakage from the resistor to the sheath are eliminated.

The mounting block for supporting the electric heating element of my invention is also preferably formed of a thermoplastic material, as is the terminal block and the end bushing within the sheath. All of these parts may be easily sealed to each other by use of adhesives, heat sealing or sonic welding, to further provide operating advantages and economies in manufacture.

DESCRIPTION OF THE DRAWINGS

In the drawings accompanying this specification and forming a part of this application, there are shown, for purpose of illustration, several embodiments which my invention may assume, and in these drawings.

DESCRIPTION OF PREFERRED EMBODIMENT

Figure 1:
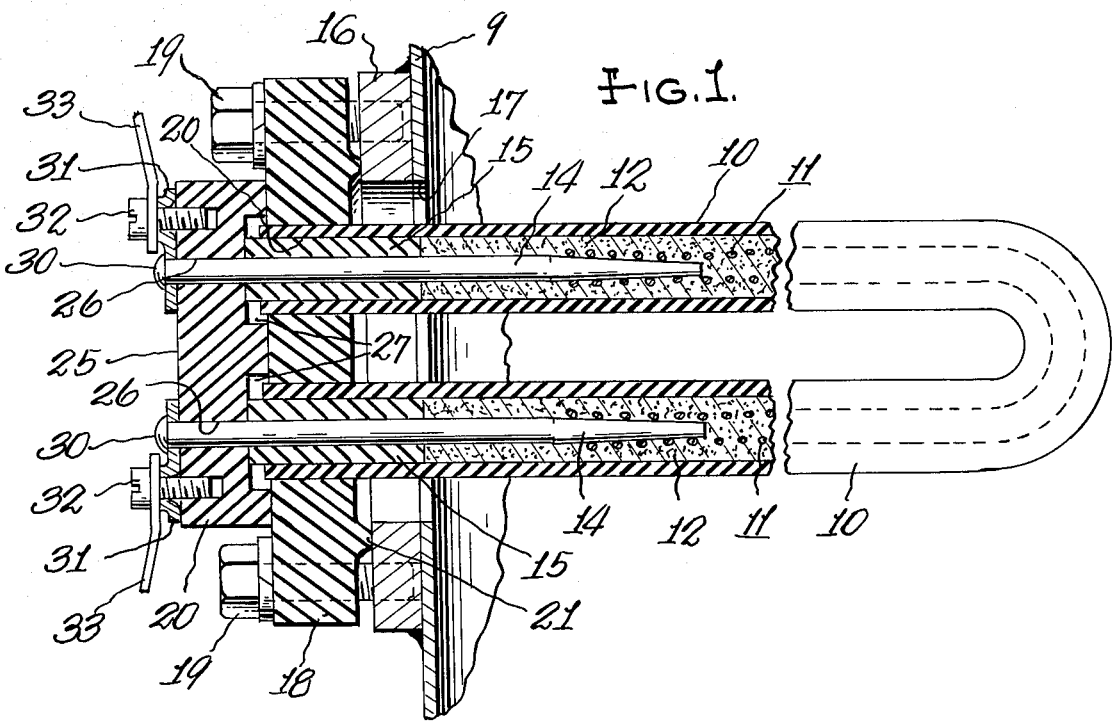
FIG. 1 is a fragmentary, longitudinal sectional view through an electric heating element shown in position to heat fluid within a tank.
Figure 2:
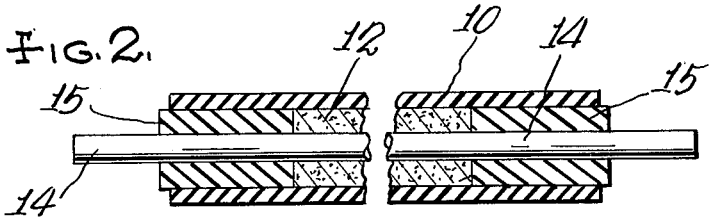
FIGS. 2 and 3 are fragmentary sectional views showing certain stages in the production of my improved heating element.
Figure 3:
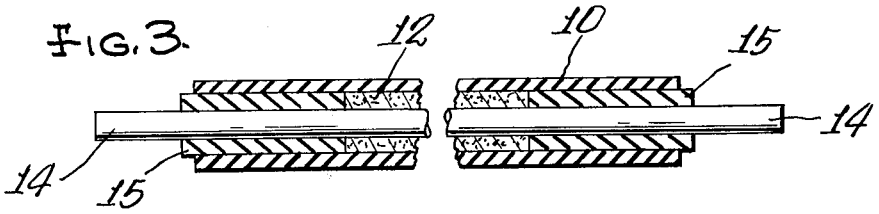

Referring particularly to FIGS. 1 through 3, the sheath 10 of the electric heating element is formed of a thermoplastic material, such as an acetal copolymer. Various plastic materials of this type are commercially available, such as Celcon made by Celanese Plastics Company, or Delrin made by DuPont, or Teflon. These materials are easily extruded into tubular form and to relatively close tolerances. The maximum temperature which these materials will withstand, before melting, is about 350° F (Teflon about 500° F) and therefore as long as the environment surrounding the sheaths formed of these materials is maintained a safe amount below maximum temperature, the sheaths will function as well and as safely as metal sheaths.

In domestic water heaters, for example, it is a requirement that a temperature limiter be used so that the water temperature within the tank does not exceed 170° F. Therefore, since in use the thermoplastic sheath is completely immersed within the water in the tank, the sheath temperature will be held within safe limits. The electric heater of my invention is particularly adapted for use with water heaters since its exposed parts are non-toxic and compatible with potable water. The material Celcon, for example, has been submitted to the Food and Drug Administration for approval, and the latter has voiced no objection to the use of Celcon in a coffee spigot, milk pump and antibiotic vial. Food contact applications of this material are steadily increasing due to its chemical resistance. Therefore, an electric heater of my invention may be used in many commercial installations, such as in heating chemical solutions, since the temperature of the liquid in such installations is limited to about 250° F, which is still within the safe temperature limits of the thermoplastic material. My improved heater may also be used as a cartridge heater wherein the sheath is disposed in closely fitting relation within a hole in a metal plate or platen, and the term "immersion" is intended to include such use. In this case the metal closely surrounding the sheath will absorb heat from the surface of the sheath and the temperature of this metal must be regulated so that it is kept below the melting point of the thermoplastic material of which the sheath is made.

Of course, if a water tank should run dry, the plastic sheathed heater would not be subjected to the modifying effects of the water and therefore the thermoplastic material would melt and the heater would fail, but metal sheathed heaters under these circumstances would also fail.

My improved electric heater may be formed in a manner similar to a metal sheathed heater. Briefly, the tubular sheath is initially a rectilinear plastic extrusion which requires no machining since it may be extruded to close tolerances. A length of plastic tubing is selected for the type and size heater to be produced and it need not be subjected to any cleaning operation under ordinary handling.

A heating resistor 11 is disposed within the plastic tube and the latter is filled with granular material 12 whose only function now is to be able to be compacted and transfer heat from the resistor to the sheath. The heating resistor 11 may be a helically coiled resistance wire or ribbon which is held generally centered within the sheath by the granular material. Normally, metal terminal pins 14 are electrically and mechanically connected to opposite ends of the resistor 11. Various commonly known techniques may be followed in properly disposing the resistor and granular material within the plastic sheath and after this is done, plastic bushings 15 are slipped over the terminal pins and seated within the opposite ends of the plastic sheath to close such ends.

The heater formed to this stage of manufacture is shown fragmentarily in FIG. 2 wherein the sheath is rectilinear with the resistor 11 (not shown in FIGS. 2 and 3) and terminal pins 14 coaxial with the sheath and spaced from the inner wall of the latter by the granular material 12. The granular material is compacted to some extent during the filling operation. However, to insure against voids, it is preferred to compact the granular material to a greater degree, and this is accomplished by reducing the diameter of the sheath. To accomplish this, a plastic sheathed heater may be subjected to rolling, swaging or side pressing. For illustration purposes, a heater made in accordance with my invention was formed with a thermoplastic sheath which originally had an outside diameter of 0.490 inches (1.2446 centimeters) and a wall thickness of 0.070 inches (0.1778 centimeters). After transverse reduction, as generally illustrated in FIG. 3, the plastic sheath had an outside diameter of 0.440 inches (1.1176 centimeters). In the heaters made so far, it was observed that the wall thickness of the plastic sheath did not change materially after transverse reduction of the sheath outside diameter and that practically all displacement of plastic occured in the lengthwise direction. This may be a phenonemon of the particular material used in the experiments and may or may not be true of all usable thermoplastics.

After transverse reduction, the heater may be bent to the hair-pin shape shown in FIG. 1 and this may be accomplished by usual bending tools. It is preferred to heat the plastic sheath a slight amount to facilitate bending, and this may be done by bending the sheath about a heated horn, and bending shoe, or by preheating the sheath in the bend area by one of several methods, such as by radiant heat, hot air and the like.

The heater is mounted on the wall 9 of a tank with its active heating portion disposed within the tank for immersion in the liquid therein. The usual hot water tanks are formed of relatively thin gauge steel and in many cases a heavy metal ring 16 is welded to the exterior of the tank wall and around the opening 17 in the tank. The heater mounting may take several forms and in the embodiment shown in FIG. 1, a mounting plate 18 is provided which is square in plan view and has holes in its four corners to pass bolts 19. The bolts are threaded into holes in the ring 16 to firmly hold the mounting flange to the tank wall. The flange 18 is formed of thermoplastic material and may be of the same type as the sheath. The flange has a pair of openings 20—20 therethrough to closely pass the ends of the two legs of the hair-pin element. In order to seal the mounting flange 18 to the ring 16, the flange may have a circular rib 21 projecting from its inner surface which is engageable with the flat facing surface of the ring 16. When the bolts 19 are properly tightened, the rib 21 will deform sufficiently to provide a gasket surface. As an alternate construction the surface of the mounting plate may be flat (without a rib 21) and a conventional gasket may be compressed between the facing surfaces of the ring and mounting plate.

As seen in FIG. 1, a separate terminal block 25 is provided. The block has a pair of openings 26 therethrough to pass the terminal pins 14. On its inside surface, the block is formed with circular recesses 27 circumscribing the openings 26. It will be noted that the outer end of the plastic bushings 15 extend beyond the ends of respective heater legs and such bushing ends abut against the surface which forms the bottom of respective recesses 27. The outer end of each terminal pin is headed, or welded, as seen at 30, over a metal conducting strip 31, and a machine screw 32 is threaded through the strip and is adapted to hold a conductor 33 in mechanical and electrical engagement with the strip.

The ends of the sheath legs, the mounting flange 18, the terminal block 25 and the bushings 15, may be hermetically sealed to each other either by use of adhesives, heat sealing or sonic welding. When adhesives are used, a suitable cement may be applied to the sheath leg ends just prior to their insertion into the openings in the flange holes 20. Then cement may be applied to the facing surfaces of the terminal block 25 and the mounting flange 18, and to the outer end surfaces of the bushings 15 and the bottom of the recesses 27, just prior to the time the terminal block is inserted over the terminal pins 14.

When heat sealing is used, a heated sealing iron may be applied to soften and seal the plastic at the junction between the sheath legs and mounting plate, and between the latter and the terminal block 25. In this case it would be difficult to heat seal the bushings and therefore a sealing cement would be used.

Figure 4A:
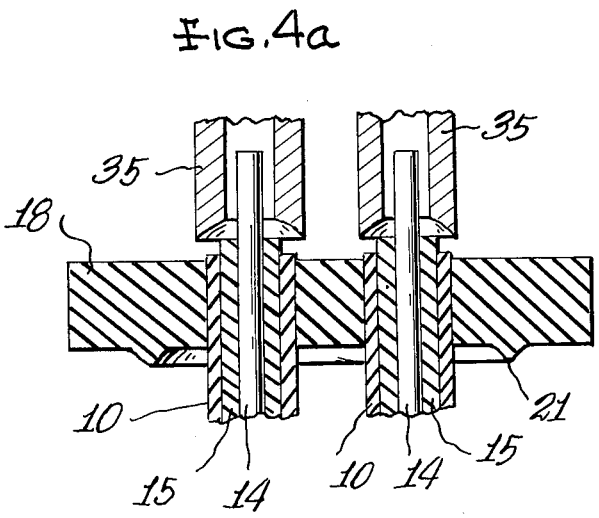
FIGS. 4*a* and 4*b* are fragmentary, sectional representations of certain parts, prepared for sonic welding.
Figure 4B:
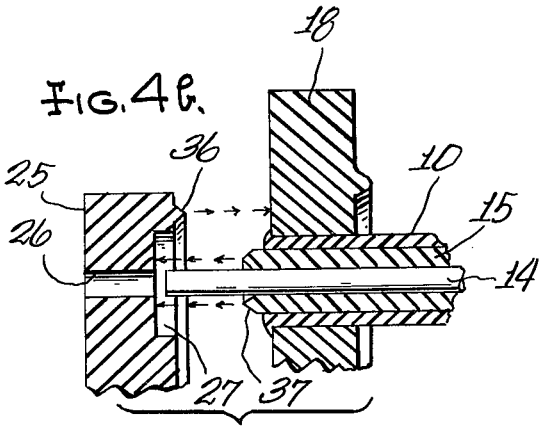

The parts may be quickly and permanently joined by sonic welding through use of commercially available welding equipment. In this case the sheath legs may be ultrasonically staked to the mounting flange 18 in the manner shown in FIG. 4*a*, wherein horns 35 of the welder are adapted to upset and weld the outer ends of the sheath legs to the mounting plate. The upset portion will be easily accommodated within the mounting plate recesses 27, as suggested in FIG. 4*b*. The inner face of the terminal block 25 may have a circular V-shaped rib 36 to serve as an energy director with respect to the facing surface of the mounting plate 18. The outer end of each bushing 15 may be formed to provide a V-shaped circular rib 37 to serve as an energy director with respect to the bottom of a respective mounting flange recess 27. The ribs 36 and 37 provide good joint design to transmit ultrasonic vibrations into the plastic parts, whereby sufficient frictional heat is generated to melt and weld the joining surfaces.

Sealing of the bushings 15 to the terminal block provides an additional benefit in that it prevents leakage of liquid through the ends of the sheath legs when an "overheat" condition exists in the liquid tank. In the usual metal-sheathed heater, when an abnormally high temperature is reached in the liquid in the tank, the metal of the sheath, being a good conductor of heat, will transfer the heat to the bushings (like the bushings 15) and melt the same. Thus, in the event the metal sheath within the liquid ruptures, liquid will be conducted through the sheath and outwardly of the sheath ends, and may cause liquid damage to the area in which the tank is located. In my improved heater, the plastic sheath does not conduct heat as well as a metal sheath so that the sheath will rupture before the bushings melt, and the bushings will therefore remain intact to seal the ends of the sheath legs.

DESCRIPTION OF THE OTHER EMBODIMENTS

Figure 5:
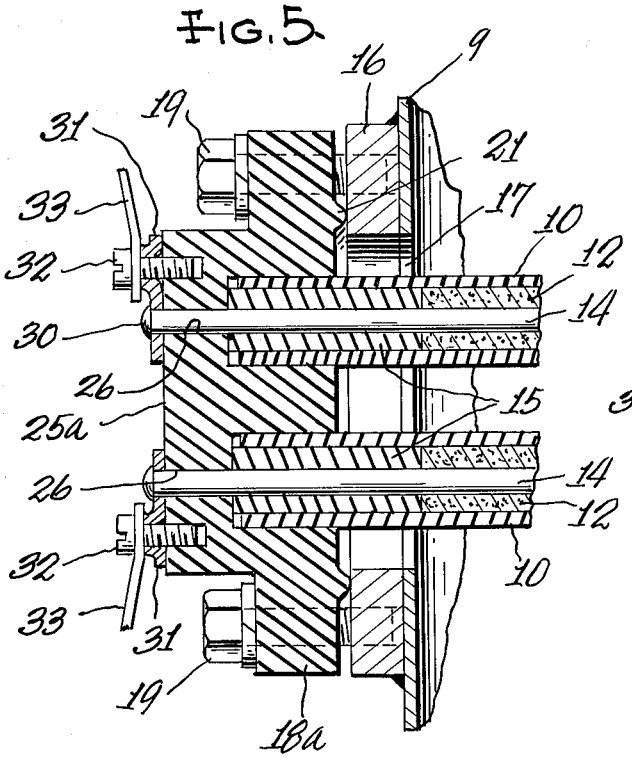
FIG. 5 is a sectional view similar to FIG. 1 but showing a slightly different construction.

In FIG. 5, the mounting flange 18*a* and terminal block 25*a* are molded as an integral unit, thus further reducing the cost of handling and joining these parts. Since it is not practical to mold the terminal block recesses 27 of FIG. 1 in the integral assembly shown in FIG. 5, these recesses are omitted; however, the bushing ends may still be hermetically sealed to the adjoining surfaces of the bottom of what now is the inner end of the openings 20*a*.

Figure 6:
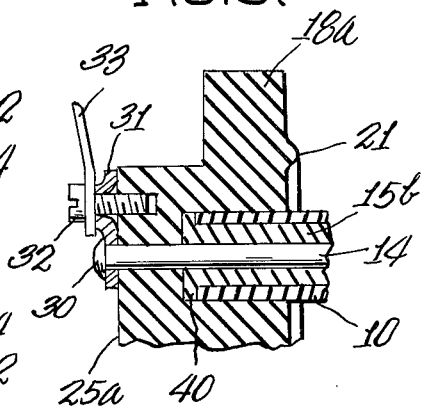
FIG. 6 is a fragmentary, sectional view of parts shown in FIG. 5, with a slightly different end seal construction.

In some cases it is preferred to use deformable rubber bushings in place of the plastic bushings 15. As seen in FIG. 6, the construction of FIG. 5 is equally adapted for use of rubber bushings 15*b*. In this case, the end of the bushing extending from the sheath leg is upset and sealed within the space between the sheath leg and the bottom of opening 20*b*, as seen at 40.

Figure 7:
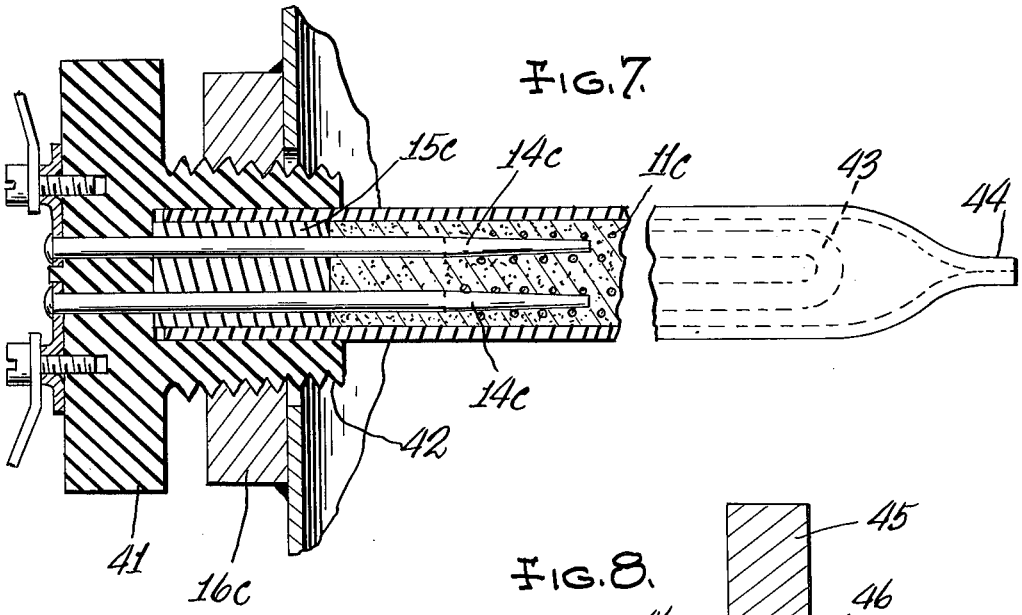
FIG. 7 shows the invention applied to a plug-type mounting and with both terminals extending from one end of the sheath.

My improved heater construction is equally adapted for use with a plug type mounting flange 41, as seen in FIG. 7, wherein pipe or other type threads 42 are molded as an integral part of the thermoplastic flange and are adapted to fit in liquid-tight relation with internal screw-threads formed on the ring 16*c*. Instead of molding, the threads may be cut on the flange. The flange 41 may support the hair-pin type heater of FIG. 1, or, as shown in FIG. 7, the heater may have a single tubular leg with the resistor 11*c* having a return bend 43 so that its free ends connect to a pair of terminal pins 14*c* which extend through holes in a single plastic bushing 15*c*. In this case, tubular ceramic spacers may be disposed over the resistor, in place of the granular material noted above. The tubular ceramic spacers are not shown in the drawing, but may be of a type well known in the art. As seen in FIG. 7, the remote end of the single leg is flattened, as shown at 44, and this end may be hermetically sealed, as by cement, heat sealing or sonic welding. Instead of flattening the tube, a cap may be threaded on the end of the tube, or a plug welded or sealed to close the tube end.

Figure 8:
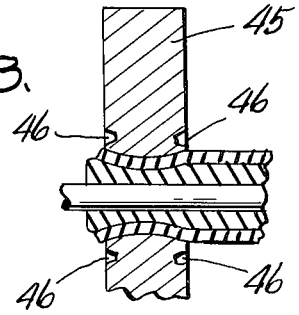
FIG. 8 is a fragmentary, sectional view showing a metal mounting plate connected to a plastic sheath.

As seen in FIG. 8, a plastic sheathed heater may be supported by a metal mounting plate 45. Opposite surfaces of the plate in the area surrounding the sheath leg have staked indentations 46 to displace the metal of the plate inwardly to effect a seal between the sheath leg and the surface defining the hole in the plate, and between the leg and the bushing.

I claim:

1. An electric heating element, comprising:

a tubular thermoplastic sheath, a resistance member within said sheath, compacted heat-conducting material within said sheath for spacing said resistance member from the inner wall surface of said sheath, and a mounting member having a hole therein for receiving an end of said sheath, said sheath end being sealed to said mounting member to prevent fluid from passing through said hole.

2. The construction according to claim 1 wherein said mounting member is thermoplastic.

3. The construction according to claim 2 wherein said mounting member has an integral rib extending from a side surface, said rib being adapted to seal against a plane surface of a support to which said mounting member is attached.

4. The construction according to claim 2 wherein a thermoplastic terminal block is secured to said mounting member, said block having terminal means connected to said resistance member and said terminal means being adapted to be connected to a source of electrical energy to cause said resistance member to generate heat, said sheath, said mounting member and said terminal block being bonded together to provide a structurally integral assembly.

5. The construction according to claim 4 wherein said terminal block is integral with said mounting member.

6. The construction according to claim 4 wherein said sheath is ultrasonically staked to said mounting member, and said terminal block is ultrasonically welded to said mounting member.

7. The construction according to claim 4 wherein said resistance member has a terminal portion extending outwardly of said sheath end and connected to said terminal means, a bushing around said terminal portion and closing said sheath end, said bushing having an end portion extending outwardly of said sheath end and bonded to said mounting member.

8. The construction according to claim 7 wherein said sheath is ultrasonically staked to said mounting member and said terminal block and said bushing end portion are ultrasonically welded to said mounting member.

9. The construction according to claim 1 wherein said mounting member is thermoplastic and is provided with threads adapted to be threaded into cooperating threads in a support member for said heating element.

10. An electric heating element, comprising:

a tubular thermoplastic sheath bent to hairpin shape to provide a pair of legs joined by a bight portion, a resistance member within said sheath and extending through said legs and bight portion, opposite ends of said resistance member being connected to terminal pins which extend outwardly of the ends of respective sheath legs and are adapted to be connected to a source of electrical energy, compacted heat-conducting material within said sheath for spacing said resistance member from the inner wall surface of said sheath, and a thermoplastic mounting member having a pair of holes for respectively receiving said sheath ends, the latter being sealed within said holes to prevent fluid from passing therethrough.

11. The construction according to claim 10 wherein said sheath ends are ultrasonically welded to said mounting member to provide a structurally integral assembly.

12. The construction according to claim 11 wherein a thermplastic terminal block is ultrasonically welded to said mounting member to provide a structurally integral assembly, said terminal block having a pair of holes to pass respective terminal pins, and terminal members carried by said terminal block and connected to said terminal pins and adapted to be connected to a source of electrical energy.

13. The construction according to claim 11 wherein said mounting member is molded to provide an integral terminal block portion, said terminal block portion having a pair of holes to pass respective terminal pins, and terminal members carried by said terminal pins and adapted to be connected to a source of electrical energy.

14. The method of heating a medium by use of an electric heating element having an active heating portion which includes a thermoplastic sheath, a resistance member within said sheath and compacted heat-conducting material within said sheath for spacing said resistance member from the inner wall surface of said sheath, comprising, immersing said active heating portion in said medium, and maintaining the temperature of said medium at a level below the melting point of the thermoplastic material of said sheath, whereby the heat-modifying effect on said sheath caused by immersion of said active heating portion within said temperature-controlled medium will permit said resistance member to generate heat above the melting point of said thermoplastic without causing failure of said sheath.

15. An electric heating element having a terminal portion including terminals adapted to be connected to a source of electrical energy, and also including an active heating portion adapted to be immersed within a temperature-controlled environment, said active heating portion comprising a tubular thermoplastic sheath, a resistance member within said sheath and electrically connected to said terminals for generating heat when said terminals are connected to said energy source, and granular heat-conducting material in which said resistance member is embedded, said heat-conducting material being in compacted form to transversely fill said sheath and to hold said resistance member spaced from the inner wall surface of said sheath, said heating element being adapted for use only in an environment which has its temperature limited to an amount below the melting point of the thermoplastic forming said sheath, whereby the heat-modifying effect on said sheath caused by immersion of said active heating portion within said temperature-controlled environment will permit said resistance member to generate heat above the melting point of said thermoplastic without causing failure of said sheath.

16. The construction according to claim 15 wherein said terminal portion of the electric heating element is also formed of a thermoplastic material and is bonded to said active heating portion.

17. The construction according to claim 15 wherein said terminal portion is adapted for connection to the wall of a liquid-containing tank with said active heating portion immersed in the liquid within said tank.

* * * * *